US005324580A

United States Patent [19]

Allan et al.

[11] Patent Number: 5,324,580

[45] Date of Patent: Jun. 28, 1994

[54] ELASTOMERIC MELTBLOWN WEBS

[75] Inventors: John L. Allan, Simpsonville; Jared A. Austin, Greer, both of S.C.

[73] Assignee: Fiberweb North America, Inc., Simpsonville, S.C.

[21] Appl. No.: 954,277

[22] Filed: Sep. 30, 1992

Related U.S. Application Data

[63] Continuation-in-part of Ser. No. 768,831, Sep. 30, 1991, abandoned.

[51] Int. Cl.[5] ..... D04H 1/04; D04H 3/16; D04H 11/08; B32B 5/22

[52] U.S. Cl. ..... 428/284; 428/296; 428/297; 428/298; 428/299; 428/326; 428/373; 428/903; 156/167; 28/104

[58] Field of Search ..... 428/326, 373, 284, 296, 428/297, 298, 299, 903; 156/167; 28/104

[56] References Cited

U.S. PATENT DOCUMENTS

| | | | |
|---|---|---|---|
| 3,849,241 | 11/1974 | Butin et al. | 156/167 |
| 4,048,364 | 9/1977 | Harding et al. | 428/198 |
| 4,323,534 | 4/1982 | DesMarais | 264/211 |
| 4,657,802 | 4/1987 | Morman | 428/152 |
| 4,663,220 | 5/1987 | Wisneski et al. | 428/288 |
| 4,692,371 | 9/1987 | Morman et al. | 428/224 |
| 4,769,279 | 9/1988 | Graham | 428/296 |
| 4,775,579 | 10/1988 | Hagy et al. | 428/284 |
| 4,814,375 | 3/1989 | Esposito | 525/93 |
| 4,874,447 | 10/1989 | Hazelton et al. | 156/167 |
| 4,892,903 | 1/1990 | Himes | 524/488 |
| 4,939,016 | 7/1990 | Radwanski et al. | 428/152 |
| 5,216,074 | 6/1993 | Imai et al. | 525/93 |

*Primary Examiner*—George F. Lesmes
*Assistant Examiner*—Kathryne E. Shelborne
*Attorney, Agent, or Firm*—Bell, Seltzer, Park & Gibson

[57] ABSTRACT

The invention is directed to elastomeric meltblown webs having desirable strength and stretch/recovery properties which can be produced at relatively high throughputs and/or relatively low die pressures. The meltblown webs of the invention comprise a blend of (i) a fully hydrogenated diblock or triblock thermoplastic elastomer copolymer or mixtures thereof based on polystyrene and poly(ethylene-butylene) blocks; and (ii) from about 5% by weight up to about 50% by weight of a copolymer of ethylene and acrylic acid or ethylene and a lower alkyl ester of acrylic acid in which the ethylene content ranges from about 5% by weight up to about 50% by weight.

10 Claims, No Drawings

ELASTOMERIC MELTBLOWN WEBS

CROSS-REFERENCE TO RELATED APPLICATIONS

This application is a continuation-in-part application of U.S. Ser. No. 07/768,831 filed Sep. 30, 1991 by John L. Allan,-et al. and entitled Bonded Composite Nonwoven Web And Process, now abandoned.

FIELD OF THE INVENTION

The invention relates to a elastomeric meltblown webs. More particularly, the invention relates to elastomeric meltblown webs produced from blends of saturated diblock and/or triblock copolymer elastomers with plasticizing copolymers which provide for the production of the elastomeric meltblown webs having desirable strength and stretch/recovery properties, at relatively high throughputs and/or relatively low die pressures.

BACKGROUND OF THE INVENTION

Elastomeric meltblown webs have been proposed for use in a variety of products including composite fabrics including hydroentangled fabrics; in diapers, training pants and other personal hygiene products in which stretch and conformability to body shapes are considered important. Fully hydrogenated (saturated) diblock and/or triblock copolymers and mixtures thereof based on polystyrene blocks and poly(ethylene-butylene) blocks have been the subject of considerable attention for producing meltblown elastomeric webs because of their high temperature stability and their ability to produce meltblown webs with desirable properties.

Commercially available polystyrene-(ethylene-butylene) diblock and triblock copolymers include the KRATON-G resins commercially available from Shell Chemical Company. Because of the high viscosities associated with these resins, the manufacturer's literature suggests blending of the resins with certain relatively low molecular weight materials. The blending of such materials with the KRATON resins can reduce the processing temperatures, thereby minimizing the degradation of the materials, or can reduce melt processing viscosities, thereby enabling throughputs to be increased at lowered pressures in extrusion processes, such as meltblowing processes. The Shell literature teaches that the lower molecular weight materials which are useful in blends include those which are compatible with the polystyrene (PS) segments of the copolymer, and materials which are compatible with the ethylene-butylene (EB) segments. Materials which are compatible with the (PS) segments include polystyrene and poly(methylacrylate) while polyolefins are compatible with the (EB) segments.

U.S. Pat. No. 4,663,220 to Wisneski and U.S. Pat. No. 4,692,371 to Morman disclose the preparation of meltblown webs from blends of saturated (PS)-(EB) diblock and triblock elastomers together with polyolefin resins. However, the preparation of meltblown webs at high throughput rates using these blends can result in processing difficulties rendering the high throughput meltblowing process uneconomical.

U.S. Pat. No. 4,323,534 to Des Marais discloses the use of fatty acids or fatty alcohols as plasticizers useful in the meltblowing of KRATON G, fully saturated elastomers. More recently, U.S. Pat. No. 4,892,203 to Himes discloses blends of the fully saturated KRATON G-type resins plasticized with anionically polymerized styrene or alpha-methyl styrene or their copolymers, or hydrogenated polystyrene. Optionally, a microcrystalline wax may also be added.

U.S. Pat. No. 4,874,447 to Hazelton discloses a method for preparing a nonwoven web from a blend comprising (i) an elastomeric copolymer of an isoolefin and a conjugated diolefin, and (ii) a thermoplastic olefin polymer resin. The elastomers (i) disclosed include copolymers of styrene and butadiene, but none of the fully hydrogenated block copolymers of the KRATON G-type are disclosed. A wide range of thermoplastic resins are disclosed as component (ii), including polyolefins, such as polyethylene, polypropylene, polybutylene, polypentene, copolymers of ethylene and propylene, copolymers of ethylene with unsaturated esters of lower carboxylic acids including copolymers of ethylene with vinylacetate or alkyl acrylates, and the like. However, the unsaturated block copolymers lack the high temperature stability of the saturated block copolymers, and thus elastomeric webs from these materials or blends of these materials can be more difficult to process.

U.S. Pat. No. 4,769,279 to Graham discloses meltblown webs formed from blends of ethylene-acrylic copolymer or ethylene-vinylacetate blended with a second fiber-forming polymer such as a polyolefin. However, the elastomeric webs formed from blends based on ethylene-acrylic copolymers and/or ethylene vinylacetate copolymers, as the elastomeric material, have only limited stretch and recovery properties.

Despite substantial effort and experimentation in the art, only a limited number of elastomeric materials have been used with any substantial commercial success to produce elastomeric webs. Moreover, various processing difficulties are still encountered when attempts are made to produce meltblown elastomeric webs at relatively high throughput rates.

SUMMARY OF THE INVENTION

The invention provides elastomeric meltblown webs which can be produced at relatively high throughputs and/or low die pressures, or both, at given melt temperatures as compared to comparable elastomeric meltblown webs produced according to prior art processes. Moreover, the invention provides elastomeric meltblown webs having improved adhesive properties.

The meltblown elastomeric webs of the invention comprise a blend of (i) a fully hydrogenated diblock or triblock thermoplastic elastomer copolymer or mixtures thereof, based on polystyrene (PS) and poly(ethylene-butylene) (EB) having the formula:

$$(PS)_a—(EB)_b \text{ or } (PS)_a—(EB)_b—(PS)_c$$

wherein a, b and c are integers; and, (ii) from about 5% by weight up to about 50% by weight of a copolymer of ethylene and acrylic acid (EAA) or a lower alkyl ester thereof such as poly(ethylene-methylacrylate) or poly(ethylene-ethylacrylate). The acrylic acid or ester component of this copolymer ranges from about 5% to about 50% by weight, preferably from about 15% to about 30% by weight. The ethylene-acrylic acid or ester copolymer is preferably present in the blend in an amount ranging from about 10% to about 40% by weight.

The elastomeric resin blends of the invention can be meltblown at higher throughput rates and/or at lower die pressures or both at given melt temperatures as compared to blends used to produce elastomeric meltblown webs in prior art processes. Nevertheless, the meltblown webs of the invention have excellent stretch and recovery properties, modulus and strength properties and other physical properties. In addition, the meltblown webs of the invention have excellent adhesive properties and thus, the meltblown webs of the invention can be provided as a component of a composite nonwoven fabric and thereafter thermally treated to bond to the composite fabric while providing elastomeric properties to the composite fabric.

DETAILED DESCRIPTION OF THE INVENTION

In the following detailed description of the preferred embodiments of the invention, specific terms are used in describing the invention; however, these are used in a descriptive sense only and not for the purpose of limitation. It will be apparent that the invention is susceptible to numerous variations and modifications within its spirit and scope.

The meltblown webs of the invention are formed by blending the elastomeric (PS)-(EB) diblock or triblock copolymers with the ethylene-acrylic acid or ethylene-acrylic acid ester copolymer and thereafter meltblowing fibers from the blended material. Meltblowing processes and apparatus are known to the skilled artisan and are disclosed, for example, in U.S. Pat. No. 3,849,241 to Buntin, et al. and U.S. Pat. No. 4,048,364 to Harding, et al., which are hereby incorporated by reference. In general, the meltblowing process involves extruding molten polymeric material through fine capillaries into fine filamentary streams. The filamentary streams exit the meltblowing spinneret head where they encounter converging streams of high velocity heated gas, typically air, supplied from converging nozzles. The converging streams of high velocity heated gas attenuate the polymer streams and break the attenuated streams into meltblown fibers.

The attenuated meltblown fibers are collected as a nonwoven mat typically at a distance within the range of about 7 inches to about 27 inches from the spinneret head. In general, the nonwoven webs which are collected at a relatively short distance will be more compact than those collected at a greater distance. The meltblown webs are collected on a moving collection device such as a rotating drum, an endless belt, or the like. Because the meltblown webs of the invention have advantageous adhesive properties, the collector device, such as a wire collector drum, can be advantageously coated with a release agent. In addition, it is preferred to cool the collector drum with fine sprays of cold water to prevent the meltblown web from sticking to the wire. Suitable release agents can be incorporated into the cooling spray.

Any of various methods well known in the prior art can be used to blend the ethylene-acrylic acid or ethylene-acrylate copolymer with the diblock and/or triblock copolymer. For example, pellets of each of the materials can be premixed or physically admixed using solid mixing equipment and the solid mixture then passed to the extruder portion of the meltblowing apparatus. Alternatively, the resins can be physically admixed together as solids and then melt blended together and the resultant meltblend passed to the extruder portion of the meltblowing apparatus.

Once the blend of the elastomeric diblock or triblock copolymer and the ethylene-acrylic acid or ethylene-acrylate copolymer has been formed, the blend is passed to the meltblowing apparatus. In general, the blend is fed into the extruder portion of the apparatus wherein it is heated to a temperature preferably within the range of between about 500° F. and about 900° F., more preferably to a temperature above about 550° F. up to about 650° F. As is well known, the extruder is driven by a suitable motor and the blend is passed through the screw portion of the extruder and forced into a die head. The die head typically contains a heating plate which may be used to impart any further thermal treatment required to render the blend suitable for meltblowing. From the die head, the feed blend is forced through a row of fine die openings and into a gas stream or streams which attenuate the blend into fibers which are collected on the moving collection device such as a rotating drum to form the continuous nonwoven web. The gas stream or streams which attenuate the fibers generally has a temperature within the range of between about 500° F. and about 900° F.

The die portion of the meltblowing apparatus includes a plurality of linearly oriented orifices having a cross-sectional flow area within the range of about $3\times10^{-6}$ sq. in. to about $7.5\times10^{-4}$ sq. in. In general, there are from about 15 to about 40 orifices per linear inch of die head.

The diblock and/or triblock elastomeric polymer used in the blend is commercially available from various sources including Shell Chemical Company as KRATON-G polymer. A particularly preferred commercially available material is KRATON G-1657 which is a mixture of 35 weight percent diblock (PS)-(EB) copolymer and 65 weight percent triblock (PS)-(EB)-(PS) copolymer. The thermoplastic elastomer is advantageously present in the blend in an amount ranging from about 50 wt. % to about 95 wt. %, preferably, from about 60 wt. % to about 80 wt. %.

The ethylene-acrylic acid copolymers and ethylene-alkyl acrylate copolymers are well known in the art. As indicated previously, the copolymers employed in the present invention have an ethylene content ranging from about 5 wt. % up to about 50 wt. % and preferably from about 15 to about 30 wt. %. Ethylene-acrylic acid copolymers and ethylene-methacrylate and ethylene-ethylacrylate copolymers are preferred for use in the invention. However, other ethylene-lower alkyl acrylate copolymers can advantageously be used herein. The term "lower alkyl" is used herein to mean straight and/or branched alkyl moieties having from one to about six carbons.

The elastomeric webs of the invention are useful in numerous environments and products. For example, the elastomeric webs of the invention can be joined to a second woven or nonwoven fabric by adhesive bonding or thermal bonding in order to impart elastic properties to the resultant composite fabric. The elastomeric web can be stretched prior to and/or during the joining process. Following bonding, the composite multi-layer fabric can be relaxed to provide a composite fabric having elastic properties.

The elastomeric webs of the invention can also be hydroentangled with staple fibers and/or wood pulp fibers as disclosed in U.S. Pat. No. 4,775,579 to Hagy, et al. which is hereby incorporated by reference. Hydroentangling of the elastomeric web with staple fibers can provide a composite fabric having aesthetic characteristics similar to those of knit textile cloth while providing desirable elastic extensibility and recovery properties.

Intimately hydroentangled composite fabrics including elastomeric webs of the invention can advantageously be thermally treated to convert the elastomeric web into a substantially film-like non-fibrous layer extending throughout the width and length of the fabric as disclosed in U.S. patent application Ser. No. 07/768,831, filed Sep. 30, 1991 by John L. Allan, et. al. and entitled Bonded Composite Nonwoven Web And Process, which is hereby incorporated by reference. Such nonwoven fabrics are provided by intimately hydroentangling a layered web including a fibrous nonwoven layer, such as a layer of carded staple fibers, with the meltblown elastomeric web of the invention. Following hydroentangling, the fabric is subjected to a bonding treatment for thermal fusion of the meltblown fibers sufficiently that the meltblown fibers are deformed into a substantially non-fibrous structure extending throughout the width and length of the fabric. The thermal bonding treatment is conducted under thermal conditions insufficient to cause substantial thermal fusion of the fibers in the fibrous layer, thus allowing the fibrous layer to maintain a desirable softness and hand.

Because the elastomeric webs of the invention exhibit advantageous adhesive properties, the above-described thermal treatment results in the firm anchoring of the fibrous materials in the composite fabric. Due to the minimal migration of the fibers of the meltblown web during hydroentanglement, the subsequent thermal fusion treatment which melts and forms the meltblown layer, has a minimal or insubstantial aesthetic effect on the remainder of the fibrous layer. Thus, the thermally fused meltblown layer is confined beneath at least one surface of the fabric so that the surface of the fabric has a desirable textile hand. Both surfaces of the composite fabric can exhibit a desirable textile-like hand by advantageous adjustment of hydroentangling conditions so that fibers from the fibrous layer are provided on both surfaces of the elastomeric web; or, at least two fibrous layers can be hydroentangled with the elastomeric web by sandwiching the elastomeric web between two fibrous layers and hydroentangling on both sides of the elastomeric web prior to thermal bonding.

The following examples serve to illustrate the elastomeric webs of the invention but are not intended to limit the invention.

In all examples, a two-inch, 36/1 length to diameter single screw extruder with a 3/1 compression ratio and five heating zones was used. A ten-inch die with 251 spinneret holes was used for meltblowing. The spinneret hole diameter was about 0.014 inches. The fibers were drawn by two streams of high velocity, heated air directed on either side of the single row of spinnerets (set back 0.040 inch with air gaps of 0.040 inch), and the fibers were collected as a web on a moving wire mesh collector. The distance from the spinnerets to the collector was 8 inches, and the collector, which was moved at a rate to achieve the desired base weight web, was cooled with fine sprays of cold water to prevent the web from sticking to the wire. Advantageously, the wire collector was coated with a release agent, or a suitable release agent could be incorporated into the fiber quench or collector table sprays.

Unless otherwise stated, physical properties reported were determined using the following test methods.

Basis weight was determined by cutting the sample using a razor blade and a metal template (measuring 50×200 mm.), and weighing to the nearest 0.001 gram after equilibration to ambient conditions. The basis weight in grams per square meter ($g/m^2$), was calculated as the weight of the sample multiplied by 100.

Web thickness (caliper) was measured using an Ames Gauge (Model 79-011; Ames, Inc., Waltham, Mass.) with a zero load and a 4 inch by 4 inch square measuring foot.

Tensile strength and elongation were measured using an Instron Tester (Model 4202; Instron Corp., Canton, Mass.). Samples (3.0 by 5.0 inch) were cut in the machine direction (MD) and the cross-machine direction (CD). Samples were mounted in 3-inch jaws at an initial separation of 4 inches and were drawn at a rate of 4 inches per minute.

For the stretch and recovery tests, the specimens were extended 100 percent, and the load was noted immediately. After the sample had been held at 100 percent extension for one minute, the load was released and the permanent extension was noted after one minute without tension. The recovery was recorded as 100 minus the percentage permanent extension. Four MD and four CD samples were tested, and averages were calculated for each.

Fresh samples were used to obtain values for the maximum load and the elongation at maximum load. Four tests were run in each case, and averages calculated for the MD and CD directions.

All load values were normalized to a base weight of 100 $g/m^2$.

Fiber diameters were determined using scanning electron micrographs taken using a Joel Model JSM-84DA unit (Joel, U.S.A., Inc., Peabody, Mass.). Specimens were sputtered-coated with gold and palladium using a Model Desk II Coater (Delton Vacuum, Inc., Cherry Hill, N.Y.) and mounted for viewing along the web z-axis. The mounts were positioned so the maximum number of fibers at a 250 or 500 magnification were aligned at right angles to the longest axis of the Polaroid print, and fiber diameters along a 3-inch line on the print were measured using a Baush and Lomb magnifier (Model 81-34-35) and scale (Model 81-34-38; Baush and Lomb, Rochester, N.Y.).

Webs and fibers were dyed using a fiber-and polymer-selective mixed dye available as Heft No. 4 (Heft, Inc., Charlotte, N.C.). Samples were immersed in an aqueous solution of the dye (3.0 weight percent) at 50° C. After one minute, the samples were air-dried on blotter stock, and the colors were compared with standards supplied by Heft, Inc. or similarly dyed specimens of known composition. Color densities (A*, Red; B*, Yellow-Red) were measured using a MacBeth Color Eye (Series 1500/Plus; MacBeth Division, Kollmorgan Corp., Newberg, N.Y.).

The thermoplastic polymers used to prepare elastomeric webs in the following examples are set forth in the following Table I:

TABLE 1

RESINS USED

| Resin | Commercially Available As | Components | Supplier | MF* |
|---|---|---|---|---|
| EVA | Escorene LD-764.36 | Ethylene/vinyl acetate (27%) | Exxon | 415 |
| (PS)(EB)(PS) | Kraton G-1657** | Styrene/ethylene-butylene (87%) | Shell | 9 |
| EMA | Optema XS-13.04 | Ethylene/methylacrylate (20%) | Exxon | 325 |
| PE(I) | Petrothene NA-250 | Ethylene (100%) | Quantum | 535 |
| PE(I) | Petrothene NA-601 | Ethylene (100%) | Quantum | ca. 5300 |
| EAA(I) | Primacor 5981 | Ethylene/acrylic acid (20%) | Dow Chem. | 725 |
| EAA(I) | Primacor 5990 | Ethylene/acrylic acid (20%) | Dow Chem. | 1340 |

*Melt flows by ASTM 1238 at 230° C. and 2.16 kg.
**Kraton G-1657 is a mixture of 35% diblock (PS)-(EB) copolymer and 65% triblock (PS)-(EB)-(PS) copolymer.

EXAMPLES 1-10

Blends containing 20% and 40% of plasticizing resins with (PS)-(EB)-(PS) were meltblown following the general method described above to obtain webs. Process conditions are given in Tables 2 and 3; physical properties of the webs are summarized in Table 4.

Data in Table 2 show that, at comparable throughputs and melt temperatures, blends of (PS)-(EB)-(PS) with EAA(I), with a melt flow of 725 gave significantly lower die pressure than blends of (PS)-(EB)-(PS) with PE(II) with a melt flow of about 5300 (Examples 1 and 5). Moreover, screw slippage and surging was apparent when using PE(II). Similarly, EMA with a melt flow of 325 gave a lower die pressure than PE(I) with a melt flow of 535, even at 11° F. lower melt temperature (Examples 2, 3, and 4). Again, slight surging was experienced with PE(I).

Similar results were obtained at the 40% plasticizer level. EAA(I) gave a lower die pressure than PE(II) (Examples 6 and 10), and EMA gave a lower die pressure than PE(I) (Examples 7, 8, and 9). Slippage was more pronounced with PE(I) and PE(II) at this higher level.

Physical data (Table 4) show that the EAA(II) and EMA plasticizers give good stretch recovery values. EAA(II) gave significant increases in the modulus, that is, the load for 100% extension.

TABLE 2

(PS)-(EB)-(PS) PLASTICIZATION PROCESS CONDITIONS
Plasticizing resin: 20 wt %; remainder (PS)-(EB)-(PS)

| Ex. | Plasticizer | Rate (lb/hr) | Screw (RPM) | Melt. Temp. (°F.) | Die Press (psig) | Air Flow (cfm) | Air Flow (°F.) |
|---|---|---|---|---|---|---|---|
| 1 | PEII | 24.6 | 41 | 622 | 680 | 350 | 615 |
| 2 | PE(I) | 23.4 | 30 | 621 | 750 | 350 | 620 |
| 3 | PE(I) | 26.7 | 36 | 620 | 800 | 350 | 620 |
| 4 | EMA | 23.3 | 35 | 611 | 725 | 350 | 629 |

TABLE 2-continued (PS)-(EB)-(PS) PLASTICIZATION PROCESS CONDITIONS
Plasticizing resin: 20 wt %; remainder (PS)-(EB)-(PS)

| Ex. | Plasticizer | Rate (lb/hr) | Screw (RPM) | Melt. Temp. (°F.) | Die Press (psig) | Air Flow (cfm) | Air Flow (°F.) |
|---|---|---|---|---|---|---|---|
| 5 | EAA(I) | 22.2 | 45 | 617 | 335 | 350 | 631 |

TABLE 3

(PS)-(EB)-(PS) PLASTICIZATION PROCESS CONDITIONS
Plasticizing resin: 40 wt %; remainder (PS)-(EB)-(PS)

| Ex. | Plasticizer | Rate (lb/hr) | Screw (RPM) | Melt. Temp. (°F.) | Die Press (psig) | Air Flow (cfm) | Air Flow (°F.) |
|---|---|---|---|---|---|---|---|
| 6 | PEII | 22.8 | 54 | 619 | 405 | 350 | 616 |
| 7 | PE(I) | 22.9 | 38 | 621 | 540 | 350 | 624 |
| 8 | EMA | 22.6 | 35 | 614 | 495 | 350 | 626 |
| 9 | EAA(I) | 22.8 | 35 | 623 | 515 | 350 | 605 |
| 10 | EAA(I) | 27.6 | 56 | 620 | 360 | 350 | 629 |

TABLE 4

WEB PHYSICAL PROPERTIES

| Ex. | Plasticizer | Base Weights (g/m²) | Caliper (mils) | Fiber Diam. (mils) | Data for 100% Stretch: Load (g/p) MD | Load (g/p) CD | Recovery (%) MD | Recovery (%) CD | Data for Max. Load: Load (g/p) MD | Load (g/p) CD | Elong (%) MD | Elong (%) CD |
|---|---|---|---|---|---|---|---|---|---|---|---|---|
| 1 | PE(II) 20% | 72 | 38 | 18.1 | 390 | 350 | 90 | 89 | 595 | 635 | 445 | 610 |
| 2 | PE(I) 20% | 67 | 50 | 21.3 | 460 | 355 | 89 | 89 | 580 | 640 | 265 | 560 |
| 3 | PE(I) 20% | 66 | 53 | 18.6 | 435 | 350 | 89 | 89 | 610 | 665 | 265 | 550 |
| 4 | EMA 20% | 63 | 30 | 17.7 | 410 | 300 | 91 | 90 | 495 | 520 | 515 | 555 |
| 5 | EAA(I) 20% | 67 | 39 | 17.8 | 1090 | 840 | 83 | 83 | 1375 | 1200 | 260 | 280 |
| 6 | PE(II) 40% | 70 | 35 | 16.4 | 700 | 685 | 86 | 87 | 900 | 870 | 315 | 370 |
| 7 | PE(I) 40% | 69 | 52 | 17.4 | 835 | 770 | 85 | 85 | 1075 | 1205 | 240 | 475 |
| 8 | EMA 40% | 66 | 28 | 17.5 | 420 | 410 | 84 | 84 | 590 | 610 | 365 | 480 |
| 9 | EAA(I) 40% | 67 | 33 | 15.1 | 500 | 440 | 85 | 85 | 620 | 615 | 375 | 390 |
| 10 | EAA(I) 40% | 69 | 31 | 23.6 | 900 | 815 | 82 | 81 | 1290 | 1205 | 260 | 310 |

EXAMPLES 11-17

Webs were meltblown from blends of (PS)-(EB)-(PS) containing increasing amounts of EMA, and from unblended (PS)-(EB)-(PS) and EMA (Tables 5 and 7). The data showed reduced die pressures with increasing amounts of EMA plasticizer.

EXAMPLES 18

A blend of 40% EMA in (PS)-(EB)-(PS) was meltblown to form a continuous web (Tables 5 and 7). No screw slippage or surging was noted at a throughput as high as 43.1 lb/hr.

EXAMPLES 19 and 20

A blend of 20% EAA(II) (melt flow 1340) with 80% (PS)-(EB)-(PS) was meltblown to a continuous web (Tables 6 and 7). Very low die pressures resulted.

EXAMPLE 21

A blend of 20% EMA in (PS)-(EB)-(PS) was meltblown to a continuous web (Tables 6 and 7). Contrary to prior art disclosures and claims, the blend was difficult to process and a very weak web was obtained which could only be collected at a high base weight.

EXAMPLE 22

Webs from Examples 11-17 were dyed with Heft No. 4 die and the intensities of the imparted A* and B* color ranges were measured. The data indicated that the intensities of the colors attributable to the EMA resin plasticizer were higher than predicted at the lower concentrations, indicating the possibility that the EMA resin was migrating to the surface of the fiber and thereby increasing fiber adhesive properties.

TABLE 5

(PS)-(EB)-(PS) PLASTICIZATION WITH EMA PROCESS CONDITIONS

| Ex. | EMA in Blend (wt %) | Rate (lb/hr) | Screw (RPM) | Melt Temp. (°F.) | Die Press. (psig) | Air Flow (cfm) | Air Flow (°F.) |
|---|---|---|---|---|---|---|---|
| 11 | 0 | 12.1 | 15 | 617 | 770 | 350 | 616 |
| 12 | 20 | 22.5 | 35 | 611 | 695 | 400 | 646 |
| 13 | 30 | 23.1 | 35 | 615 | 625 | 350 | 625 |
| 14 | 40 | 22.6 | 35 | 614 | 495 | 350 | 626 |
| 15 | 50 | 20.4 | 35 | 622 | 405 | 360 | 622 |
| 16 | 60 | 23.2 | 35 | 617 | 375 | 350 | 612 |
| 17 | 100 | 19.8 | 36 | 505 | 325 | 350 | 498 |
| 18 | 40 | 43.1 | 70 | 616 | 730 | 400 | 644 |

TABLE 6

(PS)-(EB)-(PS) PLASTICIZATION PROCESS CONDITIONS
Plasticizing resin: 20 wt %; remainder (PS)-(EB)-(PS)

| Ex. | Plasticizer | Rate (lb/hr) | Screw (RPM) | Melt Temp. (°F.) | Die Press (psig) | Air Flow (cfm) | Air Flow (°F.) |
|---|---|---|---|---|---|---|---|
| 19 | EAA(II) | 8.0 | 15 | 616 | 365 | 350 | 624 |
| 20 | EAA(II) | 16.2 | 40 | 615 | 385 | 400 | 631 |
| 21 | EVA | 21.6 | 35 | 612 | 715 | 350 | 625 |

TABLE 7

(PS)-(EB)-(PS) PLASTICIZATION WEB PHYSICAL PROPERTIES

| Ex. | Plasticizer | Base Weights (g/m²) | Caliper (mils) | Fiber Diam. (mils) | Data for 100% Stretch: Load (g/p) MD | Load (g/p) CD | Recovery (%) MD | Recovery (%) CD | Data for Max. Load: Load (g/p) MD | Load (g/p) CD | Elong (%) MD | Elong (%) CD |
|---|---|---|---|---|---|---|---|---|---|---|---|---|
| 11 | None | 57 | 21 | 20.4 | 230 | 180 | 91 | 90 | 405 | 385 | 540 | 625 |
| 12 | EMA (20%) | 60 | 25 | 13.5 | 560 | 310 | 90 | 87 | 715 | 665 | 605 | 595 |
| 13 | EMA (30%) | 66 | 32 | 19.8 | 495 | 435 | 85 | 86 | 730 | 675 | 415 | 435 |
| 14 | EMA (40%) | 82 | 33 | 17.6 | 465 | 425 | 86 | 86 | 580 | 600 | 360 | 525 |
| 15 | EMA (50%) | 66 | 33 | 14.0 | 625 | 570 | 81 | 81 | 710 | 720 | 310 | 390 |
| 16 | EMA (60%) | 70 | 32 | 14.2 | 570 | 555 | 78 | 78 | 665 | 660 | 265 | 310 |
| 17 | EMA (100%) | 65 | 43 | 24.2 | 1010 | 765 | 65 | 67 | 1135 | 955 | 150 | 220 |
| 18 | EMA (40%) | 71 | 34 | 17.0 | 460 | 405 | 84 | 84 | 665 | 635 | 345 | 405 |
| 19 | EAA(II) (20%) | 60 | 23 | 10.8 | 355 | 295 | 88 | 86 | 610 | 595 | 470 | 595 |
| 20 | EAA(II) (20%) | 57 | 22 | 17.5 | 415 | 325 | 89 | 89 | 770 | 675 | 505 | 565 |
| 21 | EVA (20%) | 152 | 53 | 19.2 | 275 | 190 | 89 | 87 | 495 | 520 | 515 | 555 |

The invention has been described in considerable detail with reference to its preferred embodiments. However, variations and modifications can be made without departure from the spirit and scope of the invention as described in the foregoing detailed specification and defined in the appended claims.

That which is claimed is:

1. A meltblown elastomeric web comprising a blend of:
   (i) a fully hydrogenated diblock or triblock thermoplastic elastomer copolymer or mixtures thereof, having the formula $(PS)_a$-$(EB)_b$ or $(PS)_a$-$(EB)_b$-$(PS)_c$ wherein (PS) represents polystyrene blocks and wherein (EB) represents poly(ethylene-butylene) blocks and a, b, and c are integers; and
   (ii) from about 5% by weight up to about 50% by weight of a plasticizing copolymer selected from the group consisting of copolymers of ethylene and acrylic acid and copolymers of ethylene and a lower alkyl acrylic acid ester wherein the acrylic acid or acrylic acid ester component of the copolymer ranges from about 5% by weight up to about 50% by weight.

2. The meltblown web of claim 1 wherein said thermoplastic elastomer copolymer or mixtures thereof is present in an amount between about 50 wt. % and 95 wt. %.

3. The meltblown web of claim 2 wherein said plasticizing copolymer is present in an amount between about 20% by weight and 40% by weight.

4. The meltblown web of claim 2 wherein the acrylic acid or acrylic acid ester component of said plasticizing copolymer is present in an amount from about 15% by weight up to about 30% by weight of said copolymer.

5. The meltblown web of claim 2 wherein said plasticizing copolymer comprises poly(ethylene-acrylic acid).

6. The meltblown web of claim 2 wherein said plasticizing copolymer comprises poly(ethylene-lower alkyl acrylate).

7. The meltblown web of claim 6 wherein said plasticizing copolymer comprises poly(ethylene-methylacrylate).

8. The meltblown web of claim 2 additionally comprising a fibrous layer comprising staple fibers, said fibrous layer being intimately-hydroentangled with said meltblown web.

9. The meltblown web of claim 4 additionally comprising a fibrous layer comprising staple fibers, said fibrous layer being intimately hydroentangled with said meltblown web.

10. The meltblown web of claim 9 wherein said intimately hydroentangled fibrous layer and meltblown web have been thermally treated sufficiently that the meltblown web is deformed into a substantially nonfibrous structure extending throughout the width and length of the fibrous layer.

* * * * *